US007150686B2

(12) United States Patent
Mitsuba

(10) Patent No.: US 7,150,686 B2
(45) **Date of Patent: *Dec. 19, 2006**

(54) GOLF CLUB HEAD

(75) Inventor: Atsuko Mitsuba, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/226,293

(22) Filed: Sep. 15, 2005

(65) Prior Publication Data

US 2006/0052182 A1 Mar. 9, 2006

Related U.S. Application Data

(63) Continuation of application No. 10/809,403, filed on Mar. 26, 2004, now Pat. No. 7,025,695.

(30) Foreign Application Priority Data

Apr. 3, 2003 (JP) ..... 2003-100789

(51) Int. Cl.
*A63B 53/04* (2006.01)

(52) U.S. Cl. ..... 473/349; 473/350

(58) Field of Classification Search ..... 473/324–350, 473/290–291; D21/747–753
See application file for complete search history.

(56) References Cited

U.S. PATENT DOCUMENTS

| | | | |
|---|---|---|---|
| 1,945,844 | A | 2/1934 | Young |
| 3,079,157 | A | 2/1963 | Turner |
| 4,645,207 | A | 2/1987 | Teramoto et al. |
| 4,836,550 | A | 6/1989 | Kobayashi |
| 5,683,310 | A | 11/1997 | Chen |
| 5,722,900 | A | 3/1998 | Sung |
| 6,458,045 | B1 | 10/2002 | Chen |
| 6,743,120 | B1 | 6/2004 | Chen |
| 6,855,069 | B1 | 2/2005 | Nagai et al. |

FOREIGN PATENT DOCUMENTS

| | | | |
|---|---|---|---|
| JP | 10-234897 | A | 9/1998 |
| JP | 2000-288128 | A | 10/2000 |
| JP | 2001-1046560 | A | 2/2001 |
| JP | 2002-143355 | A | 5/2002 |

*Primary Examiner*—Sebastiano Passaniti
(74) *Attorney, Agent, or Firm*—Birch, Stewart, Kolasch and Birch, LLP

(57) ABSTRACT

A golf club head comprises a face portion having a front face defining a club face for hitting a ball and a back surface, a sole portion extending backwards from a lower edge of the face portion, and a backside wall extending upwards from the sole portion and having a free upper end, wherein the backside wall comprises a portion inclined frontward in order to lower and deepen the center of gravity while mitigating the shock that the user's hands get at the time of miss shot.

9 Claims, 5 Drawing Sheets

GOLF CLUB HEAD

This application is a Continuation application of application Ser. No. 10/809,403, filed on Mar. 26, 2004, and for which priority is claimed under 35 U.S.C. § 120; and this application claims priority of Japanese Application No. 2003-100789 filed on Apr. 3, 2003, under 35 U.S.C. § 119. Both of the above applications are hereby incorporated by reference.

BACKGROUND OF THE INVENTION

The present invention relates to a golf club head, more particularly to a structure which can lower and deepen the center of gravity, while mitigating the shock that the user's hands get at the time of a miss shot.

It is of course desirable but difficult for amateur golfers to hit a golf ball at the sweet spot of a golf club head. If a golf ball is hit off the sweet spot, the golfer's hands experience a relatively large shock, and the hit feel is not good. This is especially remarkable in an iron-type club head provided with a backside wall for the purpose of deepening the center of gravity.

The present inventor therefore, made a study on the behavior of each portion of such a head at impact and found the major cause of the relatively large shock. Due to impact, the backside wall of the head is vibrated like a tuning fork as shown in FIG. 8, causing vibration having a duration that is relatively long and an amplitude of the vibration that becomes a maximum at the free end of the backside wall. If the toe-side and heel-side ends of the backside wall are fixed, a vibration mode as shown in FIG. 9 is liable to occur. If they are free ends, the entirety is liable to vibrate as shown in FIG. 10 with the same amplitude along the entire length. Such a vibration travels through the shaft to the user's hands as bad vibratory shock.

SUMMARY OF THE INVENTION

It is therefore, an object the present invention to provide a golf club head, in which bad shock at the time of a miss shot can be mitigated while achieving lowering and deepening of the center of gravity.

According to the present invention, a golf club head comprises a face portion having a front face defining a club face for hitting a ball and a back surface, a sole portion extending backwards from a lower edge of the face portion, and a backside wall extending upwards from the sole portion and having a free upper end, the backside wall comprising a portion inclined frontward so that the distance from said back face gradually decreases from its lower edge to upper edge.

DESCRIPTION OF THE PREFERRED EMBODIMENTS

Figure 1:
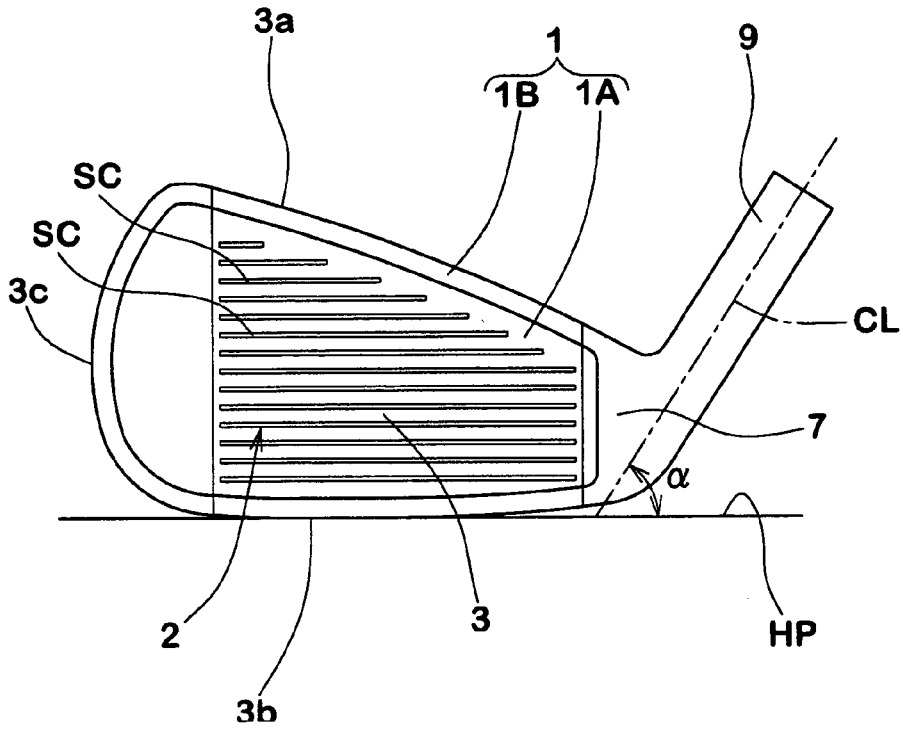
FIG. 1 is a front view of a golf club head according to the present invention.

Embodiments of the present invention will now be described in detail in conjunction with the accompanying drawings.

According to the present invention, golf club head 1 comprises: a face portion 3 having a front face defining a club face 2 for hitting a ball and a back surface B facing a hollow; a sole portion 4 extending backwards from the lower edge 3*b* of the face portion 3; a backside wall 5 extending upwards from the sole portion 4 and comprising a forward-tilted portion F inclining towards the face portion 3; and a hosel 9 attached to an end of a club shaft (not shown).

The golf club heads 1 illustrated in the drawings are iron-type metal heads, but the present invention may be applied to relatively large sized heads such as fairway woods.

In FIGS. 1, 2, 5–7, the golf club heads 1 are in the measuring state. Here, the measuring state is that the golf club head 1 is set on a horizontal plane HP such that the center line of the clubshaft or the center line CL of the hosel 9 is inclined at the lie angle alpha while keeping the center line CL on a vertical plane, and the club face 2 forms its loft angle beta with respect to the horizontal plane HP.

The undermentioned various thicknesses are measured in a vertical plane perpendicular to the club face under the measuring state unless otherwise stated.

In the following embodiments, each head 1 is formed by uniting a face plate 1A with a head main body 1B, which are preferably made of different metal materials.

The face plate 1A is to form at least the central major part of the club face 2, including the sweet spot area. In the following embodiments, the face plate 1A forms almost an entirety of the face portion 3.

The thickness of the face plate 1A or the thickness (t) of the face portion 3 between its front face 2 and back surface B is preferably set in a range of not less than 1.5 mm, more preferably more than 2.0 mm, but not more than 4.5 mm, more preferably less than 4.0 mm, still more preferably less than 3.5 mm. If the thickness (t) is less than 1.5 mm, it is difficult to obtain necessary durability. If the thickness (t) is more than 4,5 mm, the rebound performance deteriorates.

In the following embodiments, the face plate 1A has a substantially constant thickness (t), but it is also possible that the face plate has a variable thickness (t).

Incidentally, according to need, the club face 2 can be provided with face lines SC such as fine grooves and fine ridges to increase friction between the face and ball.

The head main body 1B comprises the above-mentioned sole portion 4, backside wall 5, hosel 9 and in this embodiment further a peripheral part of the face portion 3 as a frame for supporting the face plate 1A. The head main body 1B is provided at the front thereof with an opening (O) into which the face plate 1A is fitted.

The opening (O) is formed by a through hole having a step 8B at a certain depth from the front surface (2) of the head main body 1B which corresponds to the thickness of the face plate 1A. The large-sized front part 8A which is defined between the step 8B and the front surface (2) is accommodated to the face plate 1A and forms the mount 8 for the face plate 1A wherein the step 8B supports the back face 1A2 of the peripheral part of the face plate 1A, and the inner circumference of the larger front part 8A supports the outer circumference 1A1 of the face plate 1A. Thus, the substantial part of the back surface B of the face plate 1A is not supported and exposed to the hollow C. This structure facilitates deflection of the face portion 3 at impact to improve the rebound performance and also render the hit feel mild.

It is possible to further improve the rebound performance by specifically setting the Young's modulus such that the modulus E1 of the face plate 1A is in a range of 0.4 to 0.6 times the modulus E2 of the head main body 1B. In this light, for example, a combination of the face plate 1A made of a titanium alloy or pure titanium and the head main body 1B made of a stainless steel is preferred. In case of titanium face plate, the face plate 1A and head main body 1B are united with each other without utilizing welding. For example, by the face plate 1A and head main body 1B can be united by means of press fitting or caulking, adhesive agents, bolts or screws, and the like.

The sole portion 4 extends backwards from the lower edge 3*b* of the face portion 3 or the lower frame of the head main body 1B. In the toe-heel direction, the sole portion 4 extends along the lower edge 3*b* and continues to a toe-side wall 10 and a heel-side wall 7.

The toe-side wall 10 extends along the toe-side edge 3*c* while decreasing in its width in the back and forth direction of the head from the bottom to the top, and at the top the substantial width becomes almost zero.

The heel-side wall 7 is also decreased in its width while extending from the bottom to the top, and at the top the substantial width becomes almost zero. Although, due to the typical style of an iron head, the heel-side wall 7 merges into the lower portion of the hosel neck (9) and its width change is less.

The hosel 9 is formed by the hole of a tubular neck protruding upwardly from the heel-side of the head.

As the head 1 in this example is an iron type, a crown portion, which is defined as extending backwards from the upper edge 3*a* of the face portion 3, does not exist substantially.

Only a minimum width portion exists as a part of the upper frame for supporting the upper edge of the face plate 1A.

The backside wall 5 extends upwards from the rear edge 4*e* of the sole portion 4 and comprises a forward-tilted portion F inclining towards the face portion 3.

Figure 5:
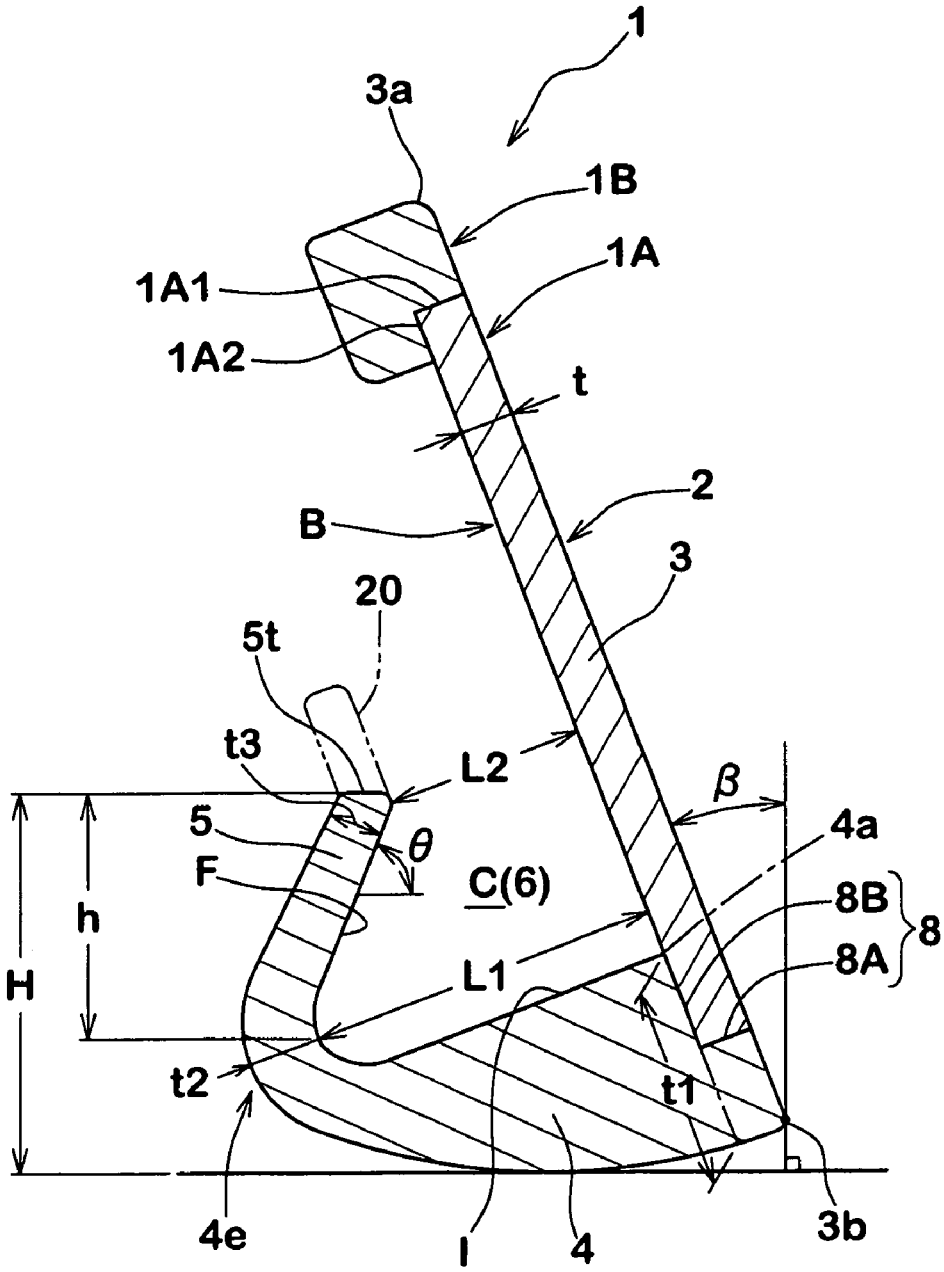
FIG. 5 is a cross sectional view of the golf club head taken along a vertical plane passing the center of gravity.

It may be possible to provide an additional wall portion 20 at the upper edge of the forward-tilted portion F as indicated in FIG. 5 with imaginary line which extends upright or inclined backwards in parallel to the back surface B. Thus, the upper edge of the forward-tilted portion F can be differed from the free upper end 5*t* of the backside wall 5. Further, it may be possible to provide an additional upright wall portion between the forward-tilted portion F and the sole portion 4 as long as its vertical extent is very small, for example less than 10% of the vertical extent (h) of the forward-tilted portion F. In the embodiments, these additional wall portions are not provided.

Under the above-mentioned measuring state, the height H from the horizontal plane HP to the free upper end 5*t* is set in a range of not more than 30 mm, more preferably less than 25 mm, but more than 3 mm, preferably more than 5 mm, more preferably more than 10 mm.

In a vertical plane perpendicular to the club face, the front surface of the forward-titled portion F is inclined at an angle theta of from 30 to 60 degrees preferably 45+5 degrees with respect to the horizontal plane HP. The front surface of the portion F is substantially straight, but it can be curved so that the tangents satisfy the above-mentioned angle limitation. The vertical extent of the front surface of the portion F from its lower edge to upper edge is in a range of from 3 to 30 mm.

As to the extent in the toe-heel direction, this forward-tilted portion F is formed along at least 50% of the entire length of the free upper end 5*t* of the backside wall 5, including its center in the toe-heel direction. Preferably, it is formed along at least 60%, more preferably more than 75% (in this example 100%) of the entire length of the backside wall 5, preferably centering on the centroid of the club face or the sweet spot.

The both ends in the toe-heel direction, of the backside wall 5 may be not connected or not fully connected to the heel-side wall 7 and toe-side wall 10. The latter (not fully) means for example that the full height of the backside wall is not connected, more specifically for example only a half height is connected.

Figure 2:
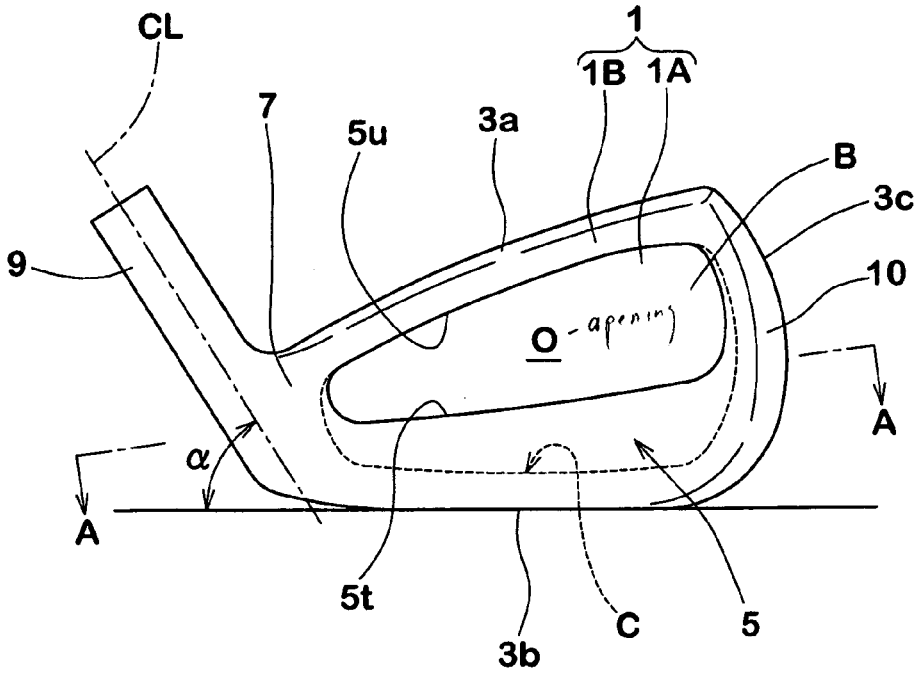
FIG. 2 is a rear view thereof.
Figure 4:
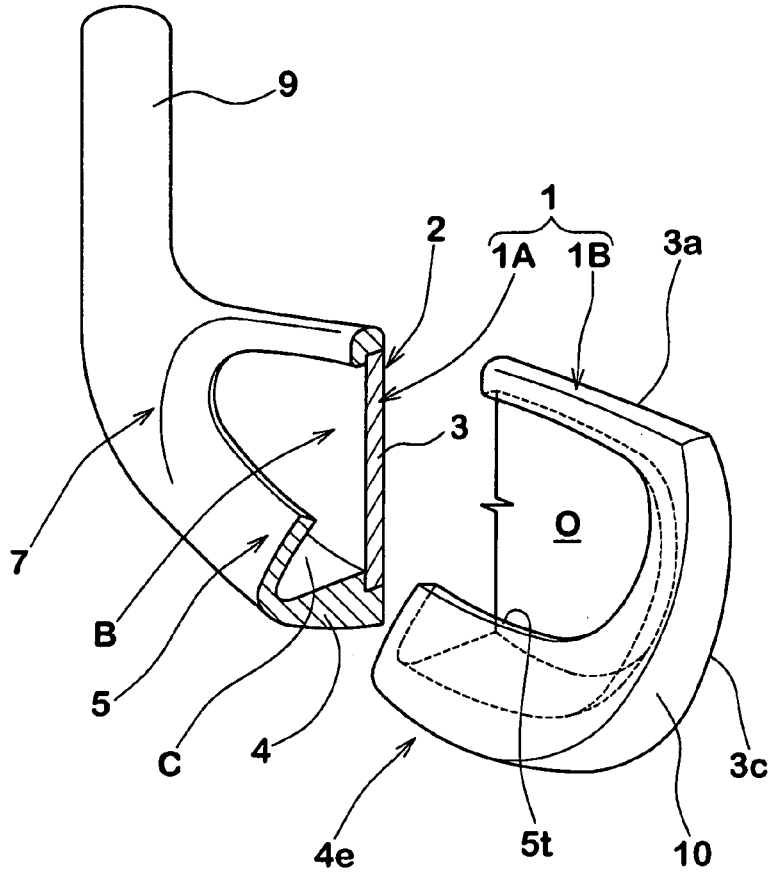
FIG. 4 is a perspective view of the golf club head.

Accordingly, a single open-top cavity C is formed between the backside wall 5 and face portion 3. As shown in FIG. 2, as viewed from the rear, the opening (O) occupies almost upper one half of the backside, and the lower edge of the opening or free upper end 5*t* is a substantially straight line which almost halves the angle formed between the upper edge 3*a* and lower edge 3*b* as viewed from the rear. On the other hand, the upper edge 5*u* is slightly curved in substantially parallel to the upper edge 3*a* as viewed from the rear.

In the embodiment shown in FIG. 5 where the face plate 1A and head main body 1B are not welded to each other as explained above, it is necessary to secure a relatively large area for supporting the back side of the face plate 1A. Therefore, the thickness t1 of the sole portion at the front end 4*a* is larger than those in the undermentioned embodiments shown in FIGS. 6 and 7.

When measured at the front end 4*a* of the sole portion 4 in parallel with the club face 2 as shown in FIG. 5, the thickness t1 is in a range of not more than 20 mm, preferably less than 11 mm, but not less than 3 mm preferably more than 5 mm.

Here, the front end 4*a* of the sole portion 4 is defined as a position at which the inner surface (I) of the sole portion 4 meets the back surface B of the face portion or a position immediately inside the above-mentioned step 8B.

When measured at the rear end 4*e* of the head perpendicularly to the club face 2, the thickness t2 is in a range of not more than 8 mm preferably less than 6 mm, but not less than 2 mm preferably more than 3 mm.

Here, the rear end 4*e* is defined as a position at which the above-mentioned maximum distance L1 lies, namely, it may be a turning point or bent point.

If the thickness t1 is more than 20 mm, it is difficult to lower the center of gravity. If the thickness t1 is less than 3 mm and/or the thickness t2 is less than 2 mm, then the above-mentioned tuning fork vibration is liable to occur and the durability decreases.

The thickness of the backside wall 5 from the rear end 4*e* to the upper end 5*t* is set to be substantially constant or preferably gradually decreased in order to prevent the tuning fork vibration and also to lower the center of gravity.

Thus, the ratio (t3/t2) of the thickness t3 at the upper end 5*t* to the thickness t2 at the rear end 4*e* is preferably not more than 1.0 more preferably less than 0.9, but not less than 0.5.

Figure 11:
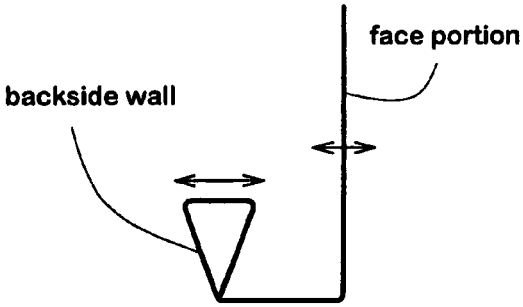
FIGS. 11 and 12 are diagrams each showing a backside wall having a thicker upper end.
Figure 12:
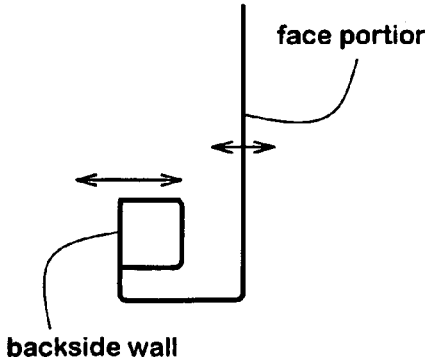

Even if the front surface (F) is inclined frontward as explained above, if the thickness of the backside wall is increased upwards as shown in FIG. 11, as the bending stress concentrates in the resultant thin lower part, the vibration is promoted and it becomes difficult to prevent the bad shock at impact. This is also true in case of a backside wall provided with an under cut as shown in FIG. 12.

In the embodiment shown in FIG. 5, the sole portion 4 is successively decreased in thickness from the front end 4*a* to the rear end 4*e*. In this case, it is preferable that the thickness ratio (t1/t2) is more than 1 and preferably not more than 3.5, more preferably not more than 2.0.

Figure 6:
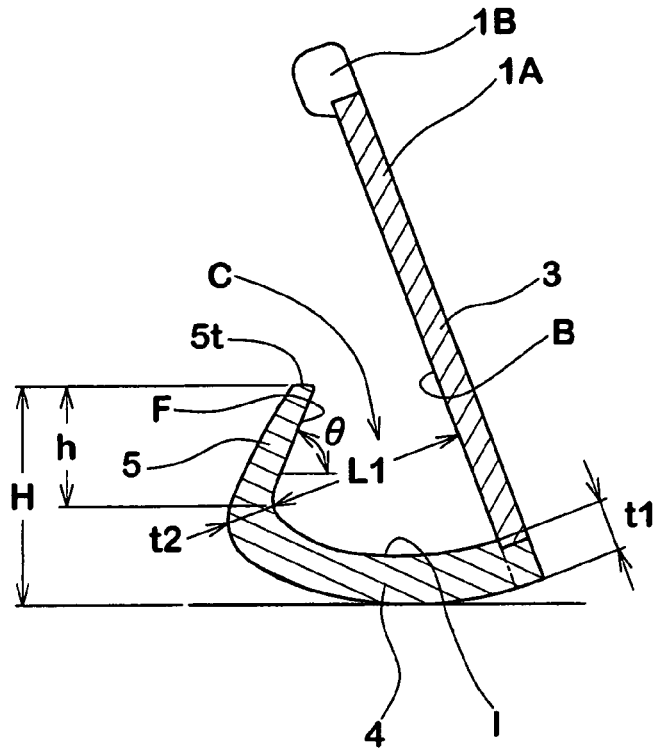
FIGS. 6 and 7 are cross sectional views similar to FIG. 5 each showing a modification of the head shown in FIG. 1.
Figure 7:
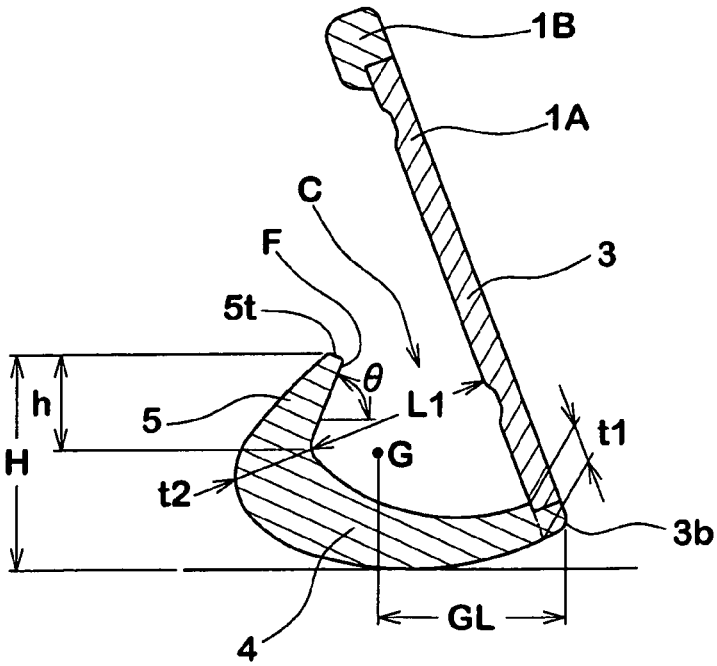
Figure 8:
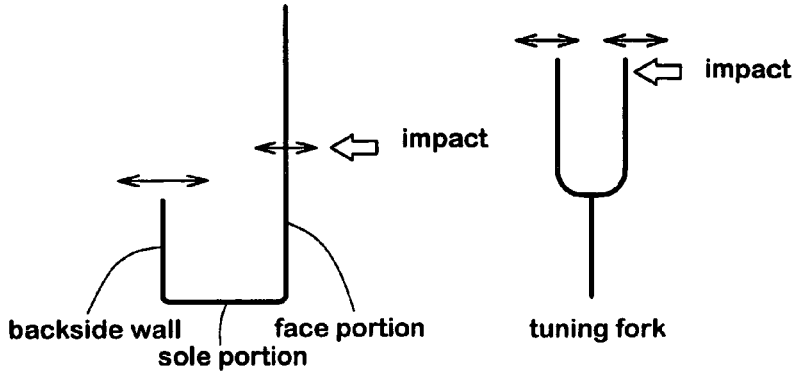
FIG. 8 is a diagram for explaining a tuning fork vibration of a club head.
Figure 9:
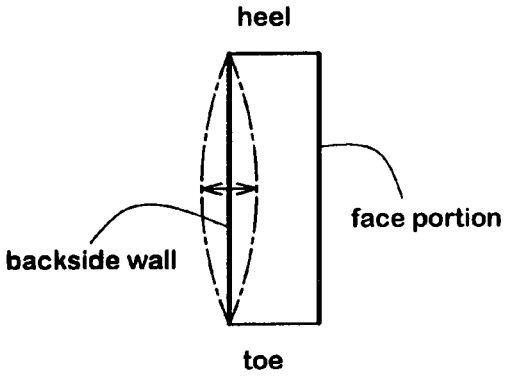
FIG. 9 is a diagram showing a vibration mode of a backside wall having fixed toe-heel ends.
Figure 10:
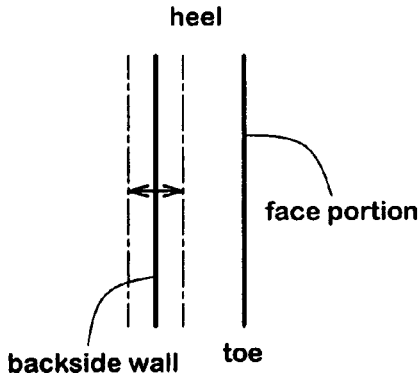
FIG. 10 is a diagram showing a vibration mode of a backside wall having free toe-heel ends.

FIGS. 6 and 7 each show another embodiment of the present invention.

Their great difference from the former embodiment is that the face plate 1A is welded to the head main body 1B. The face plate 1A and head main body 1B are made of weldable metal materials. For example, a combination of maraging steel for the face plate 1A and stainless steel for the head main body 1B is preferred. In this case, the front surface area of the step 8B for supporting the back side of the face plate 1A can be decreased. Thus, the thickness t1 at the front end 4*a* can be reduced when compared with the former embodiment, whereby the flexible area of the face portion is widened, and the rebound performance and shock may be improved.

In FIG. 6, the thickness of the sole portion 4 is substantially constant from the front end 4*a* to the rear end 4*e*.

In FIG. 7, the thickness of the sole portion 4 gradually increases from the front end 4*a* to the rear end 4*e*. In view of deepening of the center of gravity, it is preferable that the thickness ratio (t1/t2) is less than 1.0, more preferably less than 0.6 but not less than 0.2 more preferably more than 0.3.

In any case, the depth GL of the center of gravity is set in the range of not less than 4 mm, preferably more than 5 mm, but not more than 15 mm, preferably less than 13 mm. Here, the depth GL of the center of gravity is defined as the distance in the horizontal direction between the center of gravity G and the leading edge (3*b*) of the head in a vertical plane including the center of gravity G and perpendicular to the club face under the measuring state of the club head. The undermentioned height of the center of gravity is the vertical height from the horizontal plane to the center of gravity.

As the front surface of the portion F of the backside wall 5 is inclined at the specific angle as explained above, the distance between the front surface (F) and back surface B is continuously decreased from a maximum L1 to a minimum L2 as shown in FIGS. 5, 6 and 7. The minimum distance L2 must be a positive value which can prevent direct contact between the backside wall 5 and the back surface B of the face portion 3 at impact.

The maximum distance L1 must be more than 5 mm, preferably it is more than 10 mm, but less than about 120 mm, preferably less than 80 mm, more preferably less than 30 mm. The relatively large value of 120 mm for the upper limit is applied in case of fairway wood. In case of iron-type, the upper limit of 30 mm is preferred.

When the distance is measured perpendicularly to the club face 2 in a vertical plane perpendicular to the club face 2 under the measuring state, the distance ratio (L2/L1) is in the range of not less than 0.1, preferably more than 0.3, but not more than 0.7, preferably less than 0.6.

The above-mentioned club heads 1 are each made up of two parts: face plate 1A and head main body 1B. But it is also possible that the club head 1 is made up of a single body such as casting or three or more parts which may include a separate weight made of heavy metal.

Comparison Test

Hit Feel Test

Figure 3:
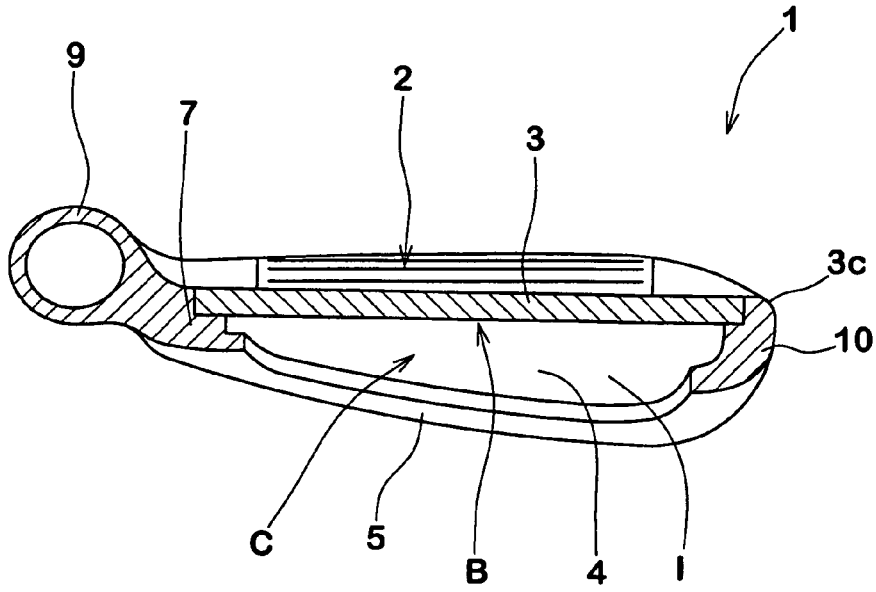
FIG. 3 is a cross sectional view taken along line A—A in FIG. 2.

Iron club heads having the configuration shown in FIGS. 1 to 3 and specifications show in Table 1 were made. Then the heads were attached to identical shafts to make iron clubs and a feeling test was conducted.

In the test, fifteen average golfers whose handicap ranged from 10 to 30 hit golf balls 20 times per a head and they evaluated the shock that their hands got when missed hitting.

In Table, the number of persons who felt the shock to be bad is indicated.

TABLE 1

| Head | Ex. 1 | Ex. 2 | Ex. 3 | Ex. 4 | Ref. 1 | Ref. 2 | Ref. 3 |
|---|---|---|---|---|---|---|---|
| L1 (mm) | 19 | 17 | 15 | 21 | 15 | 10 | 10 |
| L2 (mm) | 9.5 | 5 | 10.5 | 13.5 | 12 | 9 | 10 |
| L2/L1 | 0.5 | 0.29 | 0.7 | 0.64 | 0.8 | 0.9 | 1 |
| t1 (mm) | 10.5 | 8 | 12 | 6 | 6 | 10.5 | 10.5 |
| t2 (mm) | 3 | 8 | 5 | 10 | 14 | 2 | 2 |
| t3 (mm) | 2.5 | 6 | 3 | 9 | 6 | 3 | 3 |
| t1/t2 | 3.5 | 1 | 2.4 | 0.6 | 0.43 | 5.25 | 5.25 |
| t3/t2 | 0.83 | 0.75 | 0.6 | 0.9 | 0.43 | 1.5 | 1.5 |
| Center of gravity | | | | | | | |
| Depth (mm) | 5.5 | 7.8 | 5.8 | 13.2 | 7.5 | 4.7 | 4.8 |
| Height (mm) | 20.1 | 20.5 | 19.5 | 21 | 21.5 | 20.3 | 20.3 |
| Who felt bad (persons) | 5 | 3 | 4 | 4 | 9 | 11 | 11 |

From the test, it was confirmed that the shock can be mitigated while achieving lowering and deepening of the center of gravity. Further, as the shock can be mitigated, hit feel can be improved (became mild). Furthermore, as the height and depth of the center of gravity can be reduced, it is possible to reduce miss shots. These make the club easy to hit for the average golfers and armature golfers.

What is claimed is:

1. A golf club head comprising:

a face portion having a front face defining a club face for hitting a ball and a back surface;

a sole portion extending backwards from a lower edge of the face portion; and a backside wall extending upwards from the sole portion and having a free upper end, wherein the backside wall comprises an inclined portion inclined frontward so that a distance of a front surface of the inclined portion from said back surface of the face portion gradually decreases from a lower edge to an upper edge of the front surface of the inclined portion, and in a vertical plane perpendicular to the club face, the front surface of the inclined portion is substantially straight when the golf club head is in a measuring state.

2. The golf club head according to claim 1, wherein in said vertical plane, the front surface of the inclined portion is inclined at a substantially constant angle from 30 to 60 degrees with respect to a horizontal plane when the golf club head is in the measuring state.

3. The golf club head according to claim 2, wherein a vertical extent of said front surface of the inclined portion is in a range of from 3 to 30 mm when the golf club head is in the measuring state.

4. The golf club head according to claim 2, wherein when the golf club head is in the measuring state, a vertical extent of said front surface of the inclined portion is in a range of from 3 to 30 mm, and the upper end of the backside wall is positioned at a height in a range of from 10 to 30 mm from a horizontal plane.

5. The golf club head according to claim 1, wherein a vertical extent of said front surface of the inclined portion is in a range of from 3 to 30 mm when the golf club head is in the measuring state.

6. The golf club head according to claim 1, wherein when the golf club head is in the measuring state, a vertical extent of said front surface of the inclined portion is in a range of from 3 to 30 mm, and the upper end of the backside wall is positioned at a height in a range of from 10 to 30 mm from a horizontal plane.

7. The golf club head according to claim 1, wherein when the distance between the front surface of the inclined portion from said back surface of the face portion is measured perpendicularly to the club face, the ratio L2/L1 of a minimum value L2 to a maximum value L1 of the distance is in a range of from 01. to 0.7.

8. The golf club head according to claim 1, wherein said inclined portion has a substantially constant thickness.

9. The golf club head according to claim 1, wherein said inclined portion has a thickness gradually decreasing from the lower edge to the upper edge of the front surface of the inclined portion.

* * * * *